US010123144B2

(12) United States Patent
Lacouture Parodi

(10) Patent No.: US 10,123,144 B2
(45) Date of Patent: Nov. 6, 2018

(54) AUDIO SIGNAL PROCESSING APPARATUS AND METHOD FOR FILTERING AN AUDIO SIGNAL

(71) Applicant: Huawei Technologies Co., Ltd., Shenzhen (CN)

(72) Inventor: Yesenia Lacouture Parodi, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/666,237

(22) Filed: Aug. 1, 2017

(65) Prior Publication Data

US 2017/0332184 A1 Nov. 16, 2017

Related U.S. Application Data

(63) Continuation of application No. PCT/EP2015/053351, filed on Feb. 18, 2015.

(51) Int. Cl.

| | |
|---|---|
| ***H04S 7/00*** | (2006.01) |
| ***H04S 3/00*** | (2006.01) |
| ***H04R 3/14*** | (2006.01) |

(52) U.S. Cl.

CPC ..... *H04S 3/002* (2013.01); *H04R 3/14* (2013.01); *H04S 7/30* (2013.01); *H04S 2400/01* (2013.01); *H04S 2420/01* (2013.01)

(58) Field of Classification Search

CPC ..... H05S 1/00; H05S 3/00; H05S 3/02; H05S 3/008; H05S 2420/07; H05S 2400/01; H05S 2420/01; H05S 7/307

(Continued)

(56) References Cited

U.S. PATENT DOCUMENTS

| | | | |
|---|---|---|---|
| 5,862,227 | A | 1/1999 | Orduna-Bustamante et al. |
| 2003/0161478 | A1 | 8/2003 | Nelson et al. |

(Continued)

FOREIGN PATENT DOCUMENTS

| | | | |
|---|---|---|---|
| CN | 104160442 | A | 11/2014 |
| EP | 0776592 | B1 | 1/2002 |

(Continued)

OTHER PUBLICATIONS

Takeuchi et al., "Optimal source distribution for binaural synthesis over loudspeakers", Acoustics Research Letters Online, pp. 7-12, Acoustical Society of America, (Published Online on Dec. 28, 2000).

(Continued)

*Primary Examiner* — Melur Ramakrishnaiah

(74) *Attorney, Agent, or Firm* — Leydig, Voit & Mayer, Ltd.

(57) ABSTRACT

The disclosure relates to an audio signal processing apparatus comprising a determiner being configured to determine a filter matrix C on the basis of an acoustic transfer function matrix H and a target acoustic transfer function matrix VH, wherein the acoustic transfer function matrix H comprises transfer functions of acoustic propagation paths between loudspeakers and a listener and the target acoustic transfer function matrix VH comprises target transfer functions of target acoustic propagation paths, wherein the target acoustic propagation paths are defined by a target arrangement of virtual loudspeaker positions relative to the listener, a filter being configured to filter the input audio signal on the basis of the filter matrix C to obtain filtered input audio signals, and a combiner being configured to combine the filtered input audio signals to obtain output audio signals.

22 Claims, 6 Drawing Sheets

(58) Field of Classification Search
USPC ..... 381/303, 17, 18, 398, 310
See application file for complete search history.

(56) References Cited

U.S. PATENT DOCUMENTS

| | | | | |
|---|---|---|---|---|
| 2007/0133831 | A1 | 6/2007 | Kim et al. | |
| 2011/0268281 | A1* | 11/2011 | Florencio | H04S 1/007 381/26 |
| 2013/0163766 | A1 | 6/2013 | Choueiri | |
| 2016/0019899 | A1 | 1/2016 | Kjoerling et al. | |

FOREIGN PATENT DOCUMENTS

| | | | | |
|---|---|---|---|---|
| EP | 1545154 | A2 | 6/2005 | |
| JP | H06291741 | A | 10/1994 | |
| JP | H10509565 | A | 9/1998 | |
| JP | 2004511118 | A | 4/2004 | |
| JP | 3913775 | B2 | 5/2007 | |
| KR | 20070033860 | A | 3/2007 | |
| KR | 20130102566 | A | 9/2013 | |
| WO | 9606515 | A1 | 2/1996 | |
| WO | WO 9606515 | A1 * | 2/1996 | H04S 1/002 |
| WO | 0201916 | A2 | 1/2002 | |
| WO | 03053099 | A1 | 6/2003 | |
| WO | 2007035055 | A1 | 3/2007 | |
| WO | WO 2007035055 | A1 * | 3/2007 | H04S 3/02 |
| WO | 2012036912 | A1 | 3/2012 | |
| WO | 2015086040 | A1 | 6/2015 | |

OTHER PUBLICATIONS

Song et al., "Personal 3D Audio System with Loudspeakers," IEEE International Conference on Multimedia and Expo (ICME), Institute of Electrical and Electronic Engineers, New York, New York (2010).

Majdak et al., "Sound localization in individualized and non-individualized crosstalk cancellation systems," J. Acoust. Soc. Am. vol. 133, No. 4, pp. 2055-2068, Acoustical Society of America (Apr. 2013).

* cited by examiner

AUDIO SIGNAL PROCESSING APPARATUS AND METHOD FOR FILTERING AN AUDIO SIGNAL

CROSS-REFERENCE TO RELATED APPLICATIONS

This application is a continuation of International Application No. PCT/EP2015/053351, filed on Feb. 18, 2015, the disclosure of which is hereby incorporated by reference in its entirety.

TECHNICAL FIELD

The disclosure relates to the field of audio signal processing. In particular, the disclosure relates to an audio signal processing apparatus and method for filtering an audio signal to create a virtual sound image.

BACKGROUND

The reduction of crosstalk within audio signals is of major interest in a plurality of applications. For example, when reproducing binaural audio signals for a listener using loudspeakers, the audio signals to be heard e.g. in the left ear of the listener are usually also heard in the right ear of the listener. This effect is denoted as crosstalk and can be reduced by adding an inverse filter, also referred to in the art as crosstalk cancellation unit, into the audio reproduction chain configured to filter the audio signals.

Mathematically, the inverse filter for realizing crosstalk cancellation can be expressed as a crosstalk cancellation filter matrix C. The goal of crosstalk cancellation is to choose the crosstalk cancellation filter matrix C, more specifically its elements, in such a way that the result of a matrix multiplication of the crosstalk cancellation filter matrix C with an acoustic transfer function (ATF) matrix H is essentially equal to the identity matrix I, i.e. $H*C \approx I$, where the ATF matrix H is defined by the transfer functions from the loudspeakers to the respective ears of the listener.

Finding an exact crosstalk cancellation solution is not possible and approximations are applied. Because inverse filters are normally unstable, these approximations use a regularization in order to control the gain of the crosstalk cancellation filter and to reduce the dynamic range loss. However, due to ill-conditioning inverse filters are sensitive to errors. In other words, small errors in the reproduction chain can result in large errors at a reproduction point, resulting in a narrow sweet spot and undesired coloration as described in Takeuchi, T. and Nelson, P. A., "Optimal source distribution for binaural synthesis over loudspeakers", Journal ASA 112(6), 2002.

Audio systems are known in the art that combine crosstalk cancellation units with binauralization units for providing crosstalk free virtual surround sound, i.e. crosstalk free sound perceived by the listener to be produced at virtual loudspeaker positions. However, often such binauralization units introduce unavoidable small errors, which are then amplified by the non-prefect crosstalk cancellation units resulting in more coloration and wrong spatial perception.

SUMMARY

It is an object of the disclosure to provide an improved concept for providing an essentially crosstalk free virtual surround sound.

The disclosure is based on the idea to address the problem of crosstalk not by the error-prone serialization of a crosstalk cancellation stage and a binauralization stage, but rather by adapting the crosstalk cancellation stage to target a set of desired virtual loudspeaker positions instead of trying to directly cancel the crosstalk from the actual loudspeakers. In this way, the conventionally used binauralization stage is not needed and the error serialization is thus avoided, while rendering accurate virtual surround sound and good sound quality.

According to a first aspect, the disclosure provides an audio signal processing apparatus for filtering a left channel input audio signal to obtain a left channel output audio signal and for filtering a right channel input audio signal to obtain a right channel output audio signal, the left channel output audio signal and the right channel output audio signal to be transmitted over acoustic propagation paths to a listener, wherein transfer functions of the acoustic propagation paths are defined by an acoustic transfer function (ATF) matrix H, the audio signal processing apparatus comprising: a determiner being configured to determine a filter matrix C on the basis of the ATF matrix H and a target ATF matrix VH, wherein the target ATF matrix VH comprises target transfer functions of target acoustic propagation paths, wherein the target acoustic propagation paths are defined by a target arrangement of virtual loudspeaker positions relative to the listener; a filter being configured to filter the left channel input audio signal on the basis of the filter matrix C to obtain a first filtered left channel input audio signal and a second filtered left channel input audio signal, and to filter the right channel input audio signal on the basis of the filter matrix C to obtain a first filtered right channel input audio signal and a second filtered right channel input audio signal; and a combiner being configured to combine the first filtered left channel input audio signal and the first filtered right channel input audio signal to obtain the left channel output audio signal, and to combine the second filtered left channel input audio signal and the second filtered right channel input audio signal to obtain the right channel output audio signal. The filter can be provided by a crosstalk cancellation unit.

In a first implementation form of the audio signal processing apparatus according to the first aspect of the disclosure as such, the determiner is configured to determine the filter matrix C on the basis of the ATF matrix H and the target ATF matrix VH according to the following equation:

$$C=(H^H \cdot H+\beta(\omega)I)^{-1}(H^H \cdot VH)e^{-j\omega M},$$

wherein $H^H$ denotes the Hermitian transpose of the ATF matrix H, I denotes an identity matrix, β denotes a regularization factor, M denotes a modelling delay, and ω denotes an angular frequency.

In a second implementation form of the audio signal processing apparatus according to the first aspect of the disclosure as such, the determiner is configured to determine the filter matrix C on the basis of the ATF matrix H and the target ATF matrix VH according to the following equation:

$$C=(H^H \cdot H)^{-1}(H^H \cdot VH)e^{-j\omega M},$$

wherein $H^H$ denotes the Hermitian transpose of the ATF matrix H, M denotes a modelling delay, and ω denotes an angular frequency.

In a third implementation form of the audio signal processing apparatus according to the first aspect of the disclosure as such, the determiner is configured to determine the filter matrix C on the basis of the ATF matrix H and the target ATF matrix VH according to the following equation:

$$C=(H^H \cdot H+\beta(\omega)I)^{-1}(H^H \cdot \mathrm{phase}(VH))e^{-j\omega M},$$

wherein $H^H$ denotes the Hermitian transpose of the ATF matrix H, I denotes an identity matrix, β denotes a regularization factor, M denotes a modelling delay, ω denotes an angular frequency, and phase(A) denotes a matrix operation which returns a matrix containing only phase components of the elements of matrix A.

In a fourth implementation form of the audio signal processing apparatus according to the first aspect of the disclosure as such, the determiner is configured to determine the filter matrix C on the basis of the ATF matrix H and the target ATF matrix VH according to the following equation:

$$C=(H^H \cdot H)^{-1}(H^H \cdot \text{phase}(VH))e^{-j\omega M},$$

wherein $H^H$ denotes the Hermitian transpose of the ATF matrix H, M denotes a modelling delay, ω denotes an angular frequency, and phase(A) denotes a matrix operation which returns a matrix containing only phase components of the elements of matrix A.

In a fifth implementation form of the audio signal processing apparatus according to the first aspect of the disclosure as such or any preceding implementation form thereof, the left channel output audio signal is to be transmitted over a first acoustic propagation path between a left loudspeaker and a left ear of the listener and a second acoustic propagation path between the left loudspeaker and a right ear of the listener, wherein the right channel output audio signal is to be transmitted over a third acoustic propagation path between a right loudspeaker and the right ear of the listener and a fourth acoustic propagation path between the right loudspeaker and the left ear of the listener, and wherein a first transfer function of the first acoustic propagation path, a second transfer function of the second acoustic propagation path, a third transfer function of the third acoustic propagation path, and a fourth transfer function of the fourth acoustic propagation path form the ATF matrix.

In a sixth implementation form of the audio signal processing apparatus according to the first aspect of the disclosure as such or any preceding implementation form thereof, the target ATF matrix VH comprises a first target transfer function of a first target acoustic propagation path between a virtual left loudspeaker position and a left ear of the listener, a second target transfer function of a second target acoustic propagation path between the virtual left loudspeaker position and a right ear of the listener, a third target transfer function of a third target acoustic propagation path between a virtual right loudspeaker position and the right ear of the listener, and a fourth target transfer function of a fourth target acoustic propagation path between the virtual right loudspeaker position and the left ear of the listener.

In a seventh implementation form of the audio signal processing apparatus according to the first aspect of the disclosure as such or any preceding implementation form thereof, the determiner is further configured to retrieve the ATF matrix or the target ATF matrix from a database.

In an eighth implementation form of the audio signal processing apparatus according to the first aspect of the disclosure as such or any preceding implementation form thereof, the combiner is configured to add the first filtered left channel input audio signal and the first filtered right channel input audio signal to obtain the left channel output audio signal, and to add the second filtered left channel input audio signal and the second filtered right channel input audio signal to obtain the right channel output audio signal.

In a ninth implementation form of the audio signal processing apparatus according to the first aspect of the disclosure as such or any preceding implementation form thereof, the apparatus further comprises: a decomposer being configured to decompose the left channel input audio signal into a primary left channel input audio sub-signal and a secondary left channel input audio sub-signal, and to decompose the right channel input audio signal into a primary right channel input audio sub-signal and a secondary right channel input audio sub-signal, wherein the primary left channel input audio sub-signal and the primary right channel input audio sub-signal are allocated to a primary predetermined frequency band, and wherein the secondary left channel input audio sub-signal and the secondary right channel input audio sub-signal are allocated to a secondary predetermined frequency band; and a delayer being configured to delay the secondary left channel input audio sub-signal by a time delay to obtain a secondary left channel output audio sub-signal and to delay the secondary right channel input audio sub-signal by a further time delay to obtain a secondary right channel output audio sub-signal; wherein the filter is configured to filter the primary left channel input audio sub-signal on the basis of the filter matrix C to obtain a first filtered primary left channel input audio sub-signal and a second filtered primary left channel input audio sub-signal, and to filter the primary right channel input audio sub-signal on the basis of the filter matrix C to obtain a first filtered primary right channel input audio sub-signal and a second filtered primary right channel input audio sub-signal; wherein the combiner is configured to combine the first filtered primary left channel input audio sub-signal, the first filtered primary right channel input audio sub-signal and the secondary left channel input audio sub-signal to obtain the left channel output audio signal, and to combine the second filtered primary left channel input audio sub-signal, the second filtered primary right channel input audio sub-signal and the secondary right channel input audio sub-signal to obtain the right channel output audio signal.

In a tenth implementation form of the audio signal processing apparatus according to the ninth implementation form of the first aspect of the disclosure, the decomposer is an audio crossover network.

In an eleventh implementation form of the audio signal processing apparatus according to the first aspect of the disclosure as such or any preceding implementation form thereof, the left channel input audio signal is formed by a front left channel input audio signal of a multi-channel input audio signal and the right channel input audio signal is formed by a front right channel input audio signal of the multi-channel input audio signal and the left channel output audio signal is formed by a front left channel output audio signal and the right channel output audio signal is formed by a front right channel output audio signal, or the left channel input audio signal is formed by a back left channel input audio signal of a multi-channel input audio signal and the right channel input audio signal is formed by a back right channel input audio signal of the multi-channel input audio signal and the left channel output audio signal is formed by a back left channel output audio signal and the right channel output audio signal is formed by a back right channel output audio signal.

In a twelfth implementation form of the audio signal processing apparatus according to the eleventh implementation form of the first aspect of the disclosure, the multi-channel input audio signal comprises a center channel input audio signal, and the combiner is configured to combine the center channel input audio signal, the front left channel output audio signal, and the back left channel output audio signal, and to combine the center channel input audio signal, the front right channel output audio signal, and the back right channel output audio signal.

According to a second aspect the disclosure provides an audio signal processing method for filtering a left channel input audio signal to obtain a left channel output audio signal and for filtering a right channel input audio signal to obtain a right channel output audio signal, the left channel output audio signal and the right channel output audio signal to be transmitted over acoustic propagation paths to a listener, wherein transfer functions of the acoustic propagation paths are defined by an acoustic transfer function (ATF) matrix H, the audio signal processing method comprising the steps of: determining a filter matrix C on the basis of the ATF matrix H and a target ATF matrix VH, wherein the target ATF matrix VH comprises target transfer functions of target acoustic propagation paths, wherein the target acoustic propagation paths are defined by a target arrangement of a plurality of virtual loudspeaker positions relative to the listener; filtering the left channel input audio signal on the basis of the filter matrix C to obtain a first filtered left channel input audio signal and a second filtered left channel input audio signal, and filtering the right channel input audio signal on the basis of the filter matrix C to obtain a first filtered right channel input audio signal and a second filtered right channel input audio signal; and combining the first filtered left channel input audio signal and the first filtered right channel input audio signal to obtain the left channel output audio signal, and combining the second filtered left channel input audio signal and the second filtered right channel input audio signal to obtain the right channel output audio signal.

The method according to the second aspect of the disclosure can be performed by the apparatus according to the first aspect of the disclosure. Further features of the method according to the second aspect of the disclosure result directly from the functionality of the apparatus according to the first aspect of the disclosure and its different implementation forms.

According to a third aspect the disclosure relates to a computer program comprising program code for performing the method according to the second aspect of the disclosure when executed on a computer.

The disclosure can be implemented in hardware and/or software.

BRIEF DESCRIPTION OF THE DRAWINGS

Embodiments of the disclosure will be described with respect to the following drawings, in which.

DETAILED DESCRIPTION OF EMBODIMENTS

Figure 1:
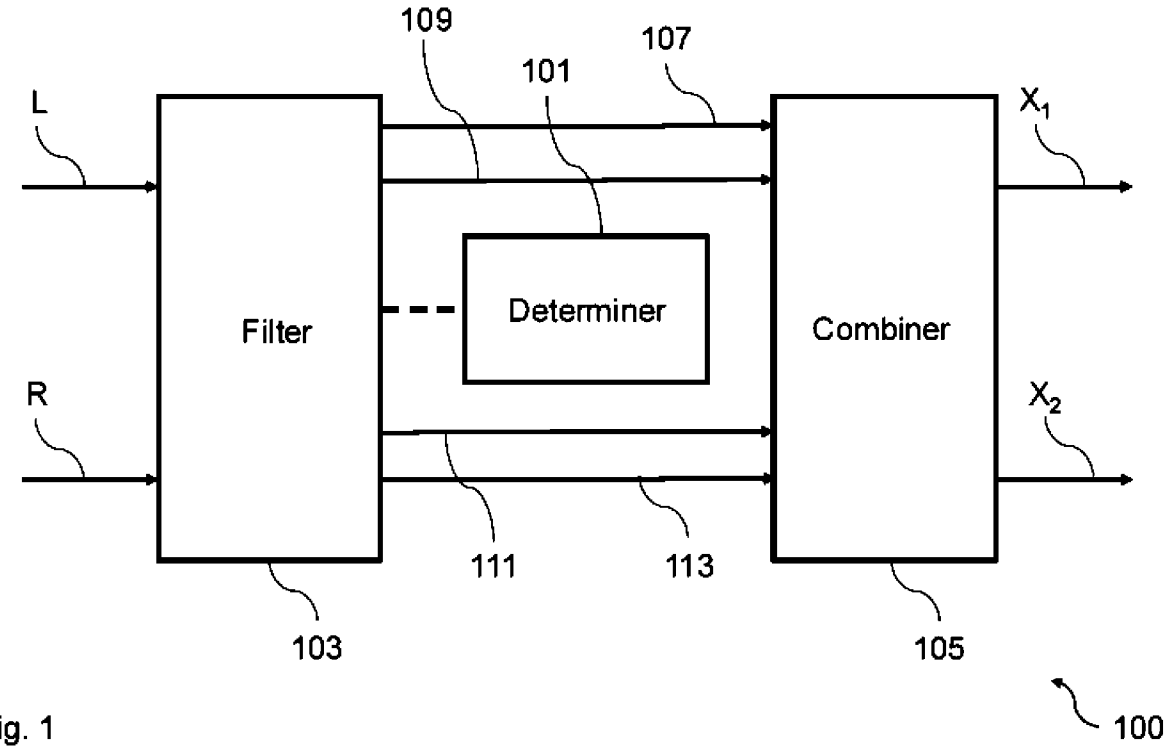
FIG. 1 shows a diagram of an audio signal processing apparatus for filtering a left channel input audio signal and a right channel input audio signal according to an embodiment.

FIG. 1 shows a diagram of an audio signal processing apparatus 100 according to an embodiment. The audio signal processing apparatus 100 is adapted to filter a left channel input audio signal L to obtain a left channel output audio signal X1 and to filter a right channel input audio signal R to obtain a right channel output audio signal X2.

The left channel output audio signal X1 and the right channel output audio signal X2 are to be transmitted over acoustic propagation paths to a listener, wherein transfer functions of the acoustic propagation paths are defined by an acoustic transfer function (ATF) matrix H.

The audio signal processing apparatus 100 comprises a determiner 101 being configured to determine a filter matrix C on the basis of the ATF matrix H and a target ATF matrix VH, wherein the target ATF matrix VH comprises target transfer functions of target acoustic propagation paths, wherein the target acoustic propagation paths are defined by a target arrangement of virtual loudspeaker positions relative to the listener.

The term "virtual loudspeaker position" (as well as "virtual loudspeaker") is well known to the person skilled in the art. By choosing suitable transfer functions the position, from which a listener perceives to receive an audio signal emitted by a loudspeaker, can differ from the real position of the loudspeaker. This position is the "virtual loudspeaker position" used herein and is associated with techniques such as stereo widening and virtual surround, wherein the virtual loudspeaker position extends beyond, for example, the physical placement of a stereo pair of loudspeakers and locations therebetween.

The audio signal processing apparatus 100 further comprises a filter 103 being configured to filter the left channel input audio signal L on the basis of the filter matrix C to obtain a first filtered left channel input audio signal 107 and a second filtered left channel input audio signal 109, and to filter the right channel input audio signal R on the basis of the filter matrix C to obtain a first filtered right channel input audio signal 111 and a second filtered right channel input audio signal 113, and a combiner 105 being configured to combine the first filtered left channel input audio signal 107 and the first filtered right channel input audio signal 111 to obtain the left channel output audio signal X1, and to combine the second filtered left channel input audio signal 109 and the second filtered right channel input audio signal 113 to obtain the right channel output audio signal X2.

Mathematically speaking, the audio signal processing apparatus 100 is not configured to determine its filter matrix C such that the product of the ATF matrix H and the filter matrix C is essentially equal to the identity matrix I (as is the case in conventional crosstalk cancellation units), but rather to determine its filter matrix C such that the product of the ATF matrix H and the filter matrix C is equal to the target ATF matrix VH defined by the target arrangement of virtual loudspeaker positions relative to the listener. More specifically, the elements of the target ATF matrix VH are defined by the transfer functions that describe the respective acoustic propagation paths from the desired virtual loudspeaker positions to the ears of the listener. These transfer functions could be head related transfer functions (HRTFs) taken from a data base or some model-based transfer functions.

In an embodiment, the determiner 101 is configured to determine the filter matrix C on the basis of the ATF matrix H and the target ATF matrix VH using a least squares approximation according to the following equation:

$$C=(H^H\cdot H+\beta(\omega)I)^{-1}(H^H\cdot VH)e^{-j\omega M}$$

wherein $H^H$ denotes the Hermitian transpose of the ATF matrix H, I denotes the identity matrix, β denotes a regularization factor, M denotes a modelling delay, and ω denotes an angular frequency.

The regularization factor β is usually employed in order to achieve stability and to constrain the gain of the filter. The larger the regularization factor β, the smaller is the filter gain, but at the expenses of reproduction accuracy and sound quality. The regularization factor β can be regarded as a controlled additive noise, which is introduced in order to achieve stability. Because the ill-conditioning of the equation system can vary with frequency, this factor can be designed to be frequency dependent.

Surprisingly, the approach suggested by the present disclosure has the advantageous side effect that in comparison to conventional crosstalk cancellation units a relatively small regularization factor β can be chosen. This is because the second term of the equation ($(H^H\cdot VH)e^{-j\omega M}$) acts as a gain control, which is optimized to reproduce accurately the desired binaural cues. That is, stability and robustness of the filter is maintained without compromising the accuracy of binaural reproduction.

Thus, in a further embodiment, the regularization factor β can be set to zero so that in this embodiment the determiner 101 is configured to determine the filter matrix C on the basis of the ATF matrix H and the target ATF matrix VH according to the following equation:

$$C=(H^H\cdot H)^{-1}(H^H\cdot VH)e^{-j\omega M}.$$

The output sound quality of the present disclosure can be further improved by using only the phase information contained in the target ATF matrix VH, i.e.:

$$H\cdot C\approx\text{phase}(VH),$$

where phase(A) denotes a matrix operation which returns a matrix containing only the phase components of the elements of the matrix A.

Thus, in a further embodiment the determiner 101 is configured to determine the filter matrix C on the basis of the ATF matrix H and the target ATF matrix VH according to the following equation:

$$C=(H^H\cdot H+\beta(\omega)I)^{-1}(H^H\cdot\text{phase}(VH))e^{-j\omega M}.$$

This approach essentially corresponds to approximating head related transfer functions (HRTFs) or transfer functions to an all-pass system, i.e. constant magnitude and variable phase. In this way inter-aural time differences (ITDs) are preserved while wrong inter-aural level differences (ILDs) are avoided, which results in considerable reduction in coloration without significantly affecting the surround sound effect.

Because of the above-described advantageous effect of the approach of the present disclosure on the regularization factor β, also for this embodiment the regularization factor β can be set to zero. Thus, in a further embodiment the determiner 101 is configured to determine the filter matrix C on the basis of the ATF matrix H and the target ATF matrix VH according to the following equation:

$$C=(H^H\cdot H)^{-1}(H^H\cdot\text{phase}(VH))e^{-j\omega M}.$$

Figure 2:
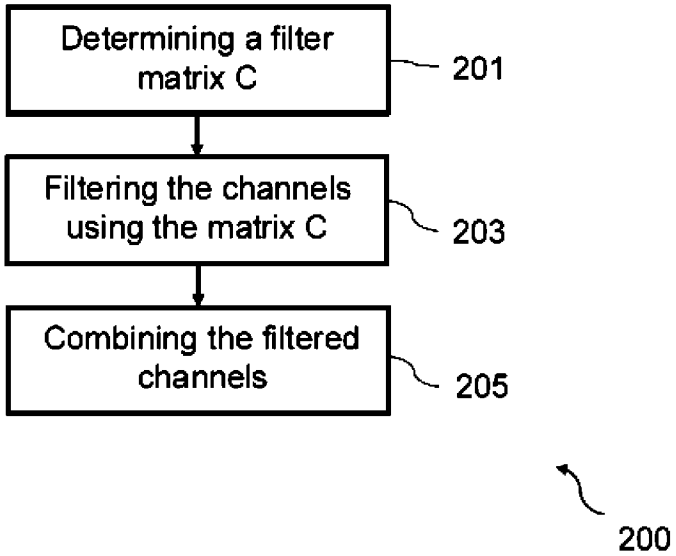
FIG. 2 shows a diagram of an audio signal processing method for filtering a left channel input audio signal and a right channel input audio signal according to an embodiment.

FIG. 2 shows a diagram of an audio signal processing method 200 according to an embodiment. The audio signal processing method 200 is adapted to filter a left channel input audio signal L to obtain a left channel output audio signal X1 and to filter a right channel input audio signal R to obtain a right channel output audio signal X2.

The left channel output audio signal X1 and the right channel output audio signal X2 are to be transmitted over acoustic propagation paths to a listener, wherein transfer functions of the acoustic propagation paths are defined by an acoustic transfer function (ATF) matrix H.

The audio signal processing method 200 comprises a step 201 of determining a filter matrix C on the basis of the ATF matrix H and a target ATF matrix VH, wherein the target ATF matrix VH comprises target transfer functions of target acoustic propagation paths, wherein the target acoustic propagation paths are defined by a target arrangement of a plurality of virtual loudspeaker positions relative to the listener, a step 203 of filtering the left channel input audio signal L on the basis of the filter matrix C to obtain a first filtered left channel input audio signal 107 and a second filtered left channel input audio signal 109, and of filtering the right channel input audio signal R on the basis of the filter matrix C to obtain a first filtered right channel input audio signal 111 and a second filtered right channel input audio signal 113, and a step 205 of combining the first filtered left channel input audio signal 107 and the first filtered right channel input audio signal 111 to obtain the left channel output audio signal X1, and combining the second filtered left channel input audio signal 109 and the second filtered right channel input audio signal 113 to obtain the right channel output audio signal X2.

One skilled in the art appreciates that the above steps can be performed serially, in parallel, or a combination thereof. For example, steps 201 and 203 can be performed in parallel to each other and in series vis-à-vis step 205.

In the following, further implementation forms and embodiments of the audio signal processing apparatus 100 and the audio signal processing method 200 are described.

Figure 3:
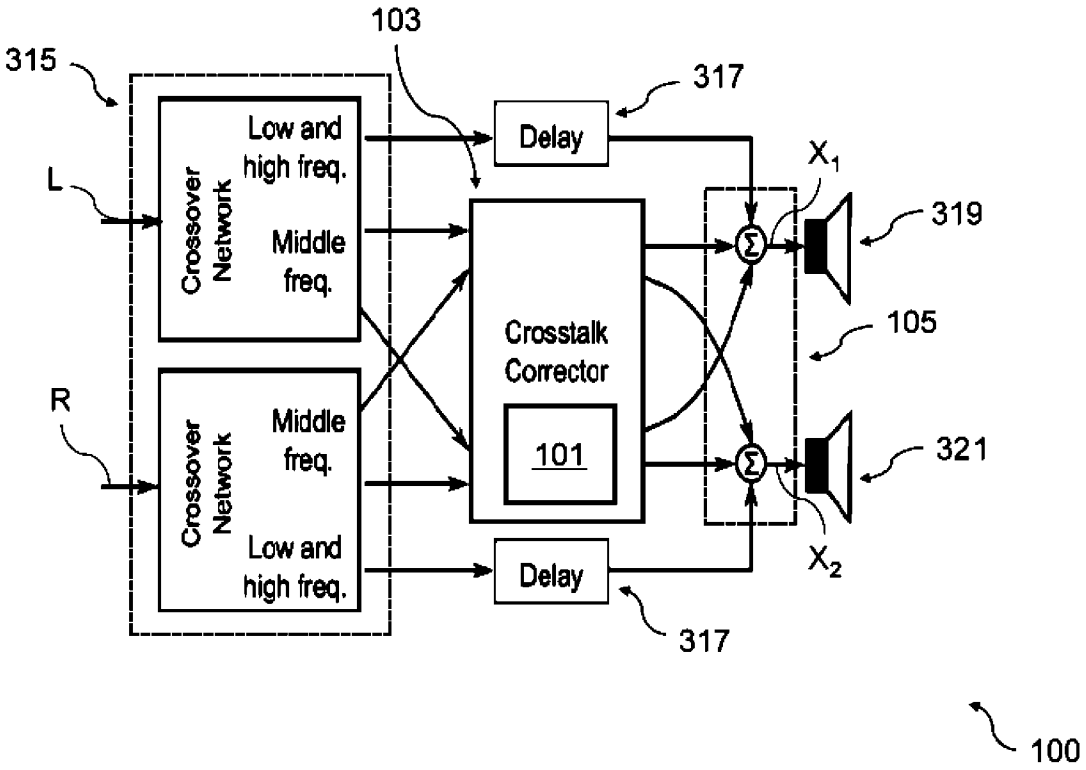
FIG. 3 shows a diagram of an audio signal processing apparatus for filtering a left channel input audio signal and a right channel input audio signal according to an embodiment.

FIG. 3 shows a diagram of an audio signal processing apparatus 100 according to an embodiment. The audio signal processing apparatus 100 is adapted to filter a left channel input audio signal L to obtain a left channel output audio signal X1 and to filter a right channel input audio signal R to obtain a right channel output audio signal X2.

The left channel output audio signal X1 and the right channel output audio signal X2 are to be transmitted over acoustic propagation paths to a listener, wherein transfer functions of the acoustic propagation paths are defined by an acoustic transfer function (ATF) matrix H.

The audio signal processing apparatus 100 comprises a determiner 101, which in the embodiment of FIG. 3 is implemented as a part of a filter 103 in form of a crosstalk corrector. The determiner 101 is configured to determine a filter matrix C on the basis of the ATF matrix H and a target ATF matrix VH, wherein the target ATF matrix VH comprises target transfer functions of target acoustic propagation paths, wherein the target acoustic propagation paths are defined by a target arrangement of virtual loudspeaker positions relative to the listener.

The audio signal processing apparatus 100 further comprises a decomposer 315 being configured to decompose the left channel input audio signal (L) into a primary left channel input audio sub-signal and a secondary left channel input audio sub-signal, and to decompose the right channel input audio signal R into a primary right channel input audio sub-signal and a secondary right channel input audio sub-signal. The primary left channel input audio sub-signal and the primary right channel input audio sub-signal are allocated to a primary predetermined frequency band, and the secondary left channel input audio sub-signal and the secondary right channel input audio sub-signal are allocated to a secondary predetermined frequency band.

The frequency decomposition can be achieved by the decomposer 315 using e.g. a low-complexity filter bank and/or an audio crossover network. The audio crossover network can be an analog audio crossover network or a digital audio crossover network. As just one example, decomposer 315, determiner 101, delayer 317, and combiner 105 may be discrete elements of a digital filter.

The audio signal processing apparatus 100 shown in FIG. 3 further comprises a delayer 317 being configured to delay the secondary left channel input audio sub-signal by a time delay to obtain a secondary left channel output audio sub-signal and to delay the secondary right channel input audio sub-signal by a further time delay to obtain a secondary right channel output audio sub-signal. Delayer 317 may be a digital delay line.

The filter 103 in form of a crosstalk corrector is configured to filter the primary left channel input audio sub-signal on the basis of the filter matrix C to obtain a first filtered primary left channel input audio sub-signal and a second filtered primary left channel input audio sub-signal, and to filter the primary right channel input audio sub-signal on the basis of the filter matrix C to obtain a first filtered primary right channel input audio sub-signal and a second filtered primary right channel input audio sub-signal.

The audio signal processing apparatus 100 shown in FIG. 3 further comprises a combiner 105 is configured to combine the first filtered primary left channel input audio sub-signal, the first filtered primary right channel input audio sub-signal and the secondary left channel input audio sub-signal to obtain the left channel output audio signal X1 to be provided to a left loudspeaker 319, and to combine the second filtered primary left channel input audio sub-signal, the second filtered primary right channel input audio sub-signal and the secondary right channel input audio sub-signal to obtain the right channel output audio signal X2 to be provided to a right loudspeaker 321.

Figure 4:
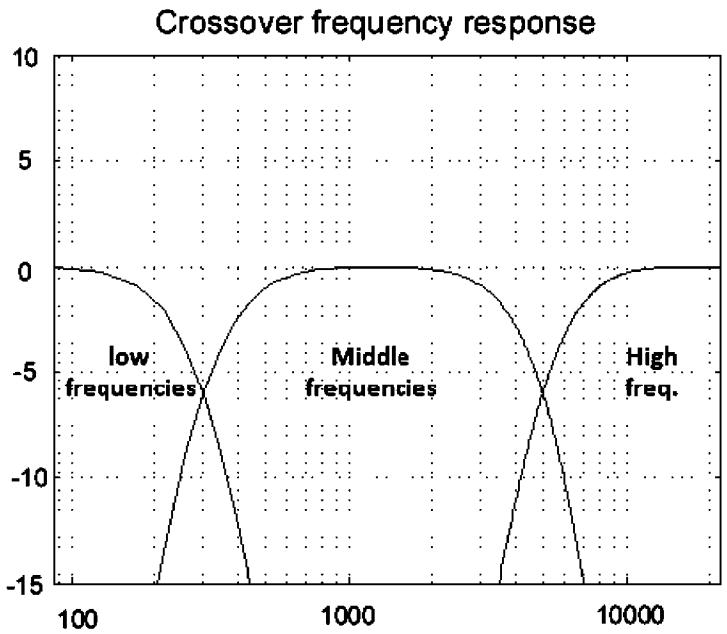
FIG. 4 shows a diagram of an allocation of frequencies to predetermined frequency bands according to an embodiment.

In an embodiment, the decomposer 315 divides the input audio signals into sub-bands considering the acoustic properties of the loudspeakers 319 and 321, such as low frequency cut-off and high frequency limit. Frequencies below the cut-off frequency and above the high frequency limit are bypassed to avoid distortions. The primary predetermined frequency band could be the band of middle frequencies shown in FIG. 4 and the secondary predetermined frequency band could be the band(s) of low and high frequencies shown in FIG. 4. In an embodiment, the decomposer 315 is an audio crossover network.

Figure 5:
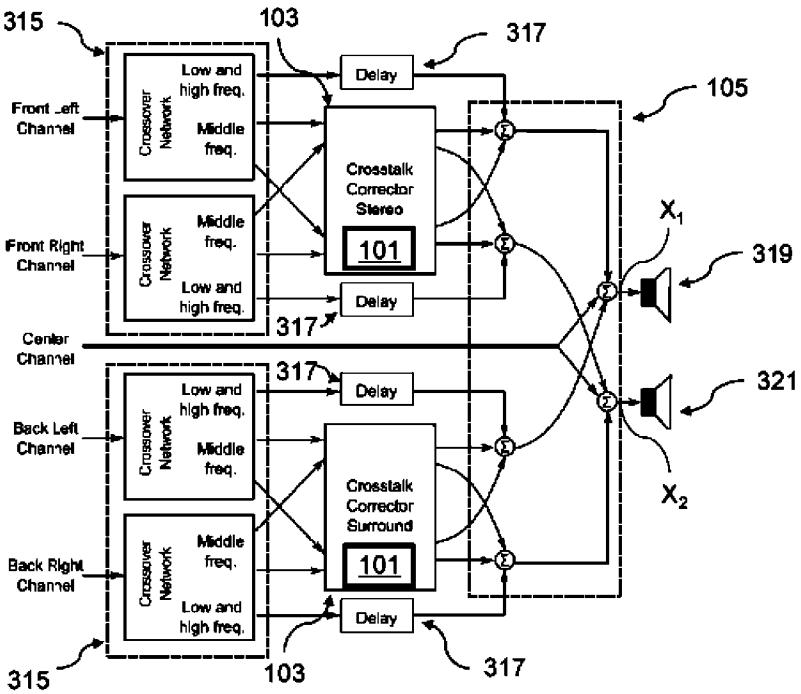
FIG. 5 shows a diagram of an audio signal processing apparatus for filtering a left channel input audio signal and a right channel input audio signal according to an embodiment.

FIG. 5 shows a diagram of an audio signal processing apparatus 100 according to an embodiment. The audio signal processing apparatus 100 is adapted to filter a left channel input audio signal to obtain a left channel output audio signal X1 and to pre-distort a right channel input audio signal to obtain a right channel output audio signal X2. The diagram refers to a virtual surround audio system for filtering a multi-channel audio signal.

The audio signal processing apparatus 100 comprises two decomposers 315, two filters 103 in form of two crosstalk correctors, two determiners 101 implemented as part of the respective crosstalk corrector, two delayers 317, and a combiner 105 having the same functionality as described in conjunction with FIG. 3. The left channel output audio signal X1 is transmitted via a left loudspeaker 319. The right channel output audio signal X2 is transmitted via a right loudspeaker 321.

In the upper portion of the diagram, the left channel input audio signal L is formed by a front left channel input audio signal of the multi-channel input audio signal and the right channel input audio signal R is formed by a front right channel input audio signal of the multi-channel input audio signal. In the lower portion of the diagram, the left channel input audio signal L is formed by a back left channel input audio signal of the multi-channel input audio signal and the right channel input audio signal R is formed by a back right channel input audio signal of the multi-channel input audio signal.

The multi-channel input audio signal further comprises a center channel input audio signal, wherein the combiner 105 is configured to combine the center channel input audio signal, the front left channel output audio signal, and the back left channel output audio signal, and to combine the center channel input audio signal, the front right channel output audio signal, and the back right channel output audio signal.

Figure 6:
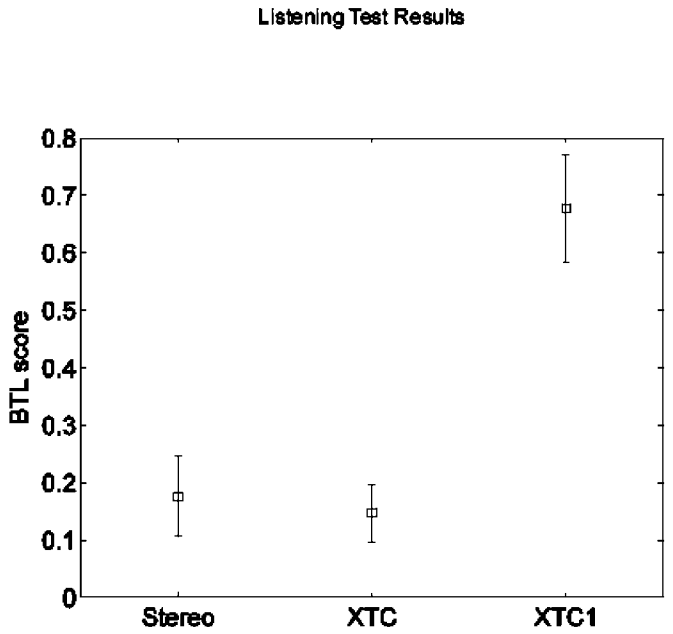
FIG. 6 shows a diagram of A/B testing results between conventional cross-talk cancellation techniques and embodiments of the present disclosure.

FIG. 6 shows a diagram of A/B testing results between conventional cross-talk cancellation techniques and embodiments of the present disclosure. The attributes evaluated were envelopment (e.g., perceived spatial impression) and sound quality (e.g., preference), The data was analyzed using the Bradley-Terry-Luce (BTL) model which gives a relative preference scale, values of which are reflected on the Y axis. The signals were presented through TV-loudspeakers. In total, 13 subjects participated in the test.

The results for the listening test compare embodiments of the present disclosure (XTC1) with conventional crosstalk cancellation (XTC), and the original stereo. It is clearly seen that the present disclosure is significantly preferred over state-of-the-art solutions with regards to wideness and sound quality.

Embodiments of the present disclosure provide amongst others the following advantages. Less regularization is needed in order to control the gain of the filters. Because the problem is no longer optimized to approximate an exact inversion but a set of transfer functions, the resulting filters are more stable and robust. Robust filters imply a wider sweet spot. Less coloration is introduced at the reproduction point and a realistic 3D sound effect can be achieved without compromising the sound quality, as it is the case with conventional solutions. The present disclosure provides a substantial reduction in complexity of the filters, given that the binauralization unit is no longer needed. The disclosure can be employed with any loudspeaker configuration (different span angles, geometries and loudspeaker size) and can be easily extended to more than two channels.

Embodiments of the disclosure are applied within audio terminals having at least two loudspeakers such as TVs, high fidelity (HiFi) systems, cinema systems, mobile devices such as smartphone or tablets, or teleconferencing systems. Embodiments of the disclosure are implemented in semiconductor chipsets.

Embodiments of the disclosure may be implemented in a computer program for running on a computer system, at least including code portions for performing steps of a method according to the disclosure when run on a programmable apparatus, such as a computer system or enabling a programmable apparatus to perform functions of a device or system according to the disclosure.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., Compact Disc-Read Only Memory (CD-ROM), Compact Disc-Recordable (CD-R), etc.) and digital video disk storage media; nonvolatile memory storage media including semiconductor-based memory units such as FLASH memory, electrically erasable programmable read-only memory (EEPROM), erasable programmable read-only memory (EPROM), read-only memory (ROM); ferromagnetic digital memories; magnetoresistive random-access memory (MRAM); volatile storage media including registers, buffers or caches, main memory, random access memory (RAM), etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the disclosure is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense. Additionally, statements made herein characterizing the disclosure refer to an embodiment of the disclosure and not necessarily all embodiments.

What is claimed is:

1. An audio signal processing apparatus for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the audio signal processing apparatus comprising a processor and a non-transitory computer-readable medium having processor-executable instructions stored thereon, wherein the processor-executable instructions, when executed by the processor, facilitate performance of the following:

determining a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of virtual loudspeaker positions relative to the listener;

filtering the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, and ω denotes an angular frequency.

2. The audio signal processing apparatus of claim 1, wherein the left channel output audio signal ($X_1$) is to be transmitted over a first acoustic propagation path between a left loudspeaker and a left ear of the listener and a second acoustic propagation path between the left loudspeaker and a right ear of the listener, wherein the right channel output audio signal ($X_2$) is to be transmitted over a third acoustic propagation path between a right loudspeaker and the right ear of the listener and a fourth acoustic propagation path between the right loudspeaker and the left ear of the listener, and wherein a first transfer function of the first acoustic propagation path, a second transfer function of the second acoustic propagation path, a third transfer function of the third acoustic propagation path, and a fourth transfer function of the fourth acoustic propagation path form the acoustic transfer function matrix (H).

3. The audio signal processing apparatus of claim 1, wherein the target acoustic transfer function matrix (VH) comprises a first target transfer function of a first target acoustic propagation path between a virtual left loudspeaker position and a left ear of the listener, a second target transfer function of a second target acoustic propagation path between the virtual left loudspeaker position and a right ear of the listener, a third target transfer function of a third target acoustic propagation path between a virtual right loudspeaker position and the right ear of the listener, and a fourth target transfer function of a fourth target acoustic propagation path between the virtual right loudspeaker position and the left ear of the listener.

4. The audio signal processing apparatus of claim 1, wherein the processor-executable instructions, when executed, further facilitate:

retrieving the acoustic transfer function matrix (H) or the target acoustic transfer function matrix (VH) from a database.

5. The audio signal processing apparatus of claim 1, wherein combining the first filtered left channel input audio signal and the first filtered right channel input audio signal to obtain the left channel output audio signal ($X_1$) comprises adding the first filtered left channel input audio signal and the first filtered right channel input audio signal to obtain the left channel output audio signal ($X_1$), and wherein combining the second filtered left channel input audio signal and the second filtered right channel input audio signal to obtain the right channel output audio signal ($X_2$) comprises adding the second filtered left channel input audio signal and the second filtered right channel input audio signal to obtain the right channel output audio signal ($X_2$).

6. The audio signal processing apparatus of claim 1, wherein the processor-executable instructions, when executed, further facilitate:

decomposing the left channel input audio signal (L) into a primary left channel input audio sub-signal and a secondary left channel input audio sub-signal, and decomposing the right channel input audio signal (R) into a primary right channel input audio sub-signal and a secondary right channel input audio sub-signal, wherein the primary left channel input audio sub-signal and the primary right channel input audio sub-signal are allocated to a primary predetermined frequency band, and wherein the secondary left channel input audio sub-signal and the secondary right channel input audio sub-signal are allocated to a secondary predetermined frequency band;

delaying the secondary left channel input audio sub-signal by a time delay to obtain a secondary left channel output audio sub-signal and delaying the secondary right channel input audio sub-signal by a further time delay to obtain a secondary right channel output audio sub-signal;

filtering the primary left channel input audio sub-signal on the basis of the filter matrix (C) to obtain a first filtered primary left channel input audio sub-signal and a second filtered primary left channel input audio sub-signal, and filtering the primary right channel input audio sub-signal on the basis of the filter matrix (C) to obtain a first filtered primary right channel input audio sub-signal and a second filtered primary right channel input audio sub-signal; and combining the first filtered primary left channel input audio sub-signal, the first filtered primary right channel input audio sub-signal and the secondary left channel input audio sub-signal to obtain the left channel output audio signal ($X_1$), and combining the second filtered primary left channel input audio sub-signal, the second filtered primary right channel input audio sub-signal and the secondary right channel input audio sub-signal to obtain the right channel output audio signal ($X_2$).

7. The audio signal processing apparatus of claim 6, wherein decomposing the left channel input audio signal (L) into a primary left channel input audio sub-signal and a secondary left channel input audio sub-signal and decomposing the right channel input audio signal (R) into a primary right channel input audio sub-signal and a secondary right channel input audio sub-signal are performed by an audio crossover network.

8. The audio signal processing apparatus of claim 1, wherein the left channel input audio signal (L) is formed by a front left channel input audio signal of a multi-channel input audio signal and the right channel input audio signal (R) is formed by a front right channel input audio signal of the multi-channel input audio signal and the left channel output audio signal ($X_1$) is formed by a front left channel output audio signal and the right channel output audio signal ($X_2$) is formed by a front right channel output audio signal; or wherein the left channel input audio signal (L) is formed by a back left channel input audio signal of a multi-channel input audio signal and the right channel input audio signal (R) is formed by a back right channel input audio signal of the multi-channel input audio signal and the left channel output audio signal ($X_1$) is formed by a back left channel output audio signal and the right channel output audio signal ($X_2$) is formed by a back right channel output audio signal.

9. The audio signal processing apparatus of claim 8, wherein the multi-channel input audio signal comprises a center channel input audio signal, and wherein the combiner is configured to combine the center channel input audio signal, the front left channel output audio signal, and the back left channel output audio signal, and to combine the center channel input audio signal, the front right channel output audio signal, and the back right channel output audio signal.

10. An audio signal processing method for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the audio signal processing method comprising:

determining, by an audio signal processing apparatus, a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of a plurality of virtual loudspeaker positions relative to the listener;

filtering, by the audio signal processing apparatus, the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining, by the audio signal processing apparatus, the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, and ω denotes an angular frequency.

11. A non-transitory computer-readable medium comprising a program code for performing an audio signal processing method for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the program code, when executed, facilitating performance of the following:

determining a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of a plurality of virtual loudspeaker positions relative to the listener;

filtering the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, and ω denotes an angular frequency.

12. An audio signal processing apparatus for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the audio signal processing apparatus comprising a processor and a non-transitory computer-readable medium having processor-executable instructions stored thereon, wherein the processor-executable instructions, when executed by the processor, facilitate performance of the following:

determining a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of virtual loudspeaker positions relative to the listener;

filtering the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, ω denotes an angular frequency, and phase(VH) denotes a matrix operation which returns a matrix containing only phase components of the elements of the target acoustic transfer function matrix (VH).

13. The audio signal processing apparatus of claim 12, wherein the left channel output audio signal ($X_1$) is to be transmitted over a first acoustic propagation path between a left loudspeaker and a left ear of the listener and a second acoustic propagation path between the left loudspeaker and a right ear of the listener, wherein the right channel output audio signal ($X_2$) is to be transmitted over a third acoustic propagation path between a right loudspeaker and the right ear of the listener and a fourth acoustic propagation path between the right loudspeaker and the left ear of the listener, and wherein a first transfer function of the first acoustic propagation path, a second transfer function of the second acoustic propagation path, a third transfer function of the third acoustic propagation path, and a fourth transfer function of the fourth acoustic propagation path form the acoustic transfer function matrix (H).

14. The audio signal processing apparatus of claim 12, wherein the target acoustic transfer function matrix (VH) comprises a first target transfer function of a first target acoustic propagation path between a virtual left loudspeaker position and a left ear of the listener, a second target transfer function of a second target acoustic propagation path between the virtual left loudspeaker position and a right ear of the listener, a third target transfer function of a third target acoustic propagation path between a virtual right loudspeaker position and the right ear of the listener, and a fourth target transfer function of a fourth target acoustic propagation path between the virtual right loudspeaker position and the left ear of the listener.

15. The audio signal processing apparatus of claim 12, wherein the processor-executable instructions, when executed, further facilitate:

retrieving the acoustic transfer function matrix (H) or the target acoustic transfer function matrix (VH) from a database.

16. The audio signal processing apparatus of claim 12, wherein combining the first filtered left channel input audio signal and the first filtered right channel input audio signal to obtain the left channel output audio signal ($X_1$) comprises adding the first filtered left channel input audio signal and the first filtered right channel input audio signal to obtain the left channel output audio signal ($X_1$), and wherein combining the second filtered left channel input audio signal and the second filtered right channel input audio signal to obtain the right channel output audio signal ($X_2$) comprises adding the second filtered left channel input audio signal and the second filtered right channel input audio signal to obtain the right channel output audio signal ($X_2$).

17. The audio signal processing apparatus of claim 12, wherein the processor-executable instructions, when executed, further facilitate:

decomposing the left channel input audio signal (L) into a primary left channel input audio sub-signal and a secondary left channel input audio sub-signal, and decomposing the right channel input audio signal (R) into a primary right channel input audio sub-signal and a secondary right channel input audio sub-signal, wherein the primary left channel input audio sub-signal and the primary right channel input audio sub-signal are allocated to a primary predetermined frequency band, and wherein the secondary left channel input audio sub-signal and the secondary right channel input audio sub-signal are allocated to a secondary predetermined frequency band;

delaying the secondary left channel input audio sub-signal by a time delay to obtain a secondary left channel output audio sub-signal and delaying the secondary right channel input audio sub-signal by a further time delay to obtain a secondary right channel output audio sub-signal;

filtering the primary left channel input audio sub-signal on the basis of the filter matrix (C) to obtain a first filtered primary left channel input audio sub-signal and a second filtered primary left channel input audio sub-signal, and filtering the primary right channel input audio sub-signal on the basis of the filter matrix (C) to obtain a first filtered primary right channel input audio sub-signal and a second filtered primary right channel input audio sub-signal; and combining the first filtered primary left channel input audio sub-signal, the first filtered primary right channel input audio sub-signal and the secondary left channel input audio sub-signal to obtain the left channel output audio signal ($X_1$), and combining the second filtered primary left channel input audio sub-signal, the second filtered primary right channel input audio sub-signal and the secondary right channel input audio sub-signal to obtain the right channel output audio signal ($X_2$).

18. The audio signal processing apparatus of claim 17, wherein decomposing the left channel input audio signal (L) into a primary left channel input audio sub-signal and a secondary left channel input audio sub-signal and decomposing the right channel input audio signal (R) into a primary right channel input audio sub-signal and a secondary right channel input audio sub-signal are performed by an audio crossover network.

19. The audio signal processing apparatus of claim 12, wherein the left channel input audio signal (L) is formed by a front left channel input audio signal of a multi-channel input audio signal and the right channel input audio signal (R) is formed by a front right channel input audio signal of the multi-channel input audio signal and the left channel output audio signal ($X_1$) is formed by a front left channel output audio signal and the right channel output audio signal ($X_2$) is formed by a front right channel output audio signal; or wherein the left channel input audio signal (L) is formed by a back left channel input audio signal of a multi-channel input audio signal and the right channel input audio signal (R) is formed by a back right channel input audio signal of the multi-channel input audio signal and the left channel output audio signal ($X_1$) is formed by a back left channel output audio signal and the right channel output audio signal ($X_2$) is formed by a back right channel output audio signal.

20. The audio signal processing apparatus of claim 19, wherein the multi-channel input audio signal comprises a center channel input audio signal, and wherein the combiner is configured to combine the center channel input audio signal, the front left channel output audio signal, and the back left channel output audio signal, and to combine the center channel input audio signal, the front right channel output audio signal, and the back right channel output audio signal.

21. An audio signal processing method for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the audio signal processing method comprising:

determining, by an audio signal processing apparatus, a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of a plurality of virtual loudspeaker positions relative to the listener;

filtering, by the audio signal processing apparatus, the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining, by the audio signal processing apparatus, the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, ω denotes an angular frequency, and phase(VH) denotes a matrix operation which returns a matrix containing only phase components of the elements of the target acoustic transfer function matrix (VH).

22. A non-transitory computer-readable medium comprising a program code for performing an audio signal processing method for filtering a left channel input audio signal (L) to obtain a left channel output audio signal ($X_1$) and for filtering a right channel input audio signal (R) to obtain a right channel output audio signal ($X_2$), the left channel output audio signal ($X_1$) and the right channel output audio signal ($X_2$) to be transmitted over acoustic propagation paths to a listener, wherein transfer functions of the acoustic propagation paths are defined by an acoustic transfer function matrix (H), the program code, when executed, facilitating performance of the following:

determining a filter matrix (C) on the basis of the acoustic transfer function matrix (H) and a target acoustic transfer function matrix (VH), wherein the target acoustic transfer function matrix (VH) comprises target transfer functions of target acoustic propagation paths, wherein the target acoustic propagation paths are defined by a target arrangement of a plurality of virtual loudspeaker positions relative to the listener;

filtering the left channel input audio signal (L) on the basis of the filter matrix (C) to obtain a first filtered left channel input audio signal and a second filtered left channel input audio signal, and filtering the right channel input audio signal (R) on the basis of the filter matrix (C) to obtain a first filtered right channel input audio signal and a second filtered right channel input audio signal; and combining the first filtered left channel input audio signal and the first filtered right channel input audio signal to obtain the left channel output audio signal ($X_1$), and combining the second filtered left channel input audio signal and the second filtered right channel input audio signal to obtain the right channel output audio signal ($X_2$);

wherein determining the filter matrix (C) on the basis of the acoustic transfer function matrix (H) and the target acoustic transfer function matrix (VH) is according to the following equation:

$$C=(H^H\cdot H+\beta(\omega)I)^{-1}(H^H\cdot VH)e^{-j\omega M},$$

wherein $H^H$ denotes the Hermitian transpose of the acoustic transfer function matrix (H), I denotes an identity matrix, β denotes a regularization factor, M denotes a modelling delay, ω denotes an angular frequency, and phase(VH) denotes a matrix operation which returns a matrix containing only phase components of the elements of the target acoustic transfer function matrix (VH).

* * * * *